United States Patent [19]

Yamamura et al.

[11] Patent Number: 5,023,003

[45] Date of Patent: Jun. 11, 1991

[54] SOFTENER COMPOSITION CONTAINING CIS- AND TRANS- ISOMERS OF ETHYLENICALLY UNSATURATED QUATERNARY AMMONIUM SALTS

[75] Inventors: Masaaki Yamamura, Tochigi, Japan; Kazuhiko Okabe, Barcelona, Spain; Kohshiro Sotoya, Wakayama; Moriyasu Murata, Chibashi, both of Japan

[73] Assignee: Kao Corporation, Tokyo, Japan

[21] Appl. No.: 437,882

[22] Filed: Nov. 17, 1989

[30] Foreign Application Priority Data

Nov. 21, 1988 [JP] Japan ..... 63-294316

[51] Int. Cl.[5] ..... D06M 11/58; D06M 15/647; C11D 1/62; C11D 3/16

[52] U.S. Cl. ..... 252/8.8; 252/8.6; 252/8.9; 252/547; 252/174.15; 252/174.21

[58] Field of Search ..... 252/8.6, 8.8, 547, 174.15, 252/174.21

[56] References Cited

U.S. PATENT DOCUMENTS

| | | | |
|---|---|---|---|
| 4,022,938 | 5/1977 | Zaki et al. | 252/8.6 |
| 4,134,840 | 1/1979 | Minegishi et al. | 252/8.9 |
| 4,187,289 | 2/1980 | Eckhardt | 252/8.8 |
| 4,661,269 | 4/1987 | Trinh et al. | 252/8.8 |
| 4,767,548 | 8/1988 | Kasprzak et al. | 252/8.6 |
| 4,789,491 | 12/1988 | Chang et al. | 252/8.6 |
| 4,822,499 | 4/1989 | Wahl et al. | 252/8.8 |

FOREIGN PATENT DOCUMENTS

| | | | |
|---|---|---|---|
| 0112376 | 8/1980 | Japan | 252/8.8 |
| 3165498 | 12/1986 | Japan | 252/8.8 |
| 2263379 | 11/1987 | Japan | 252/8.8 |

*Primary Examiner*—A. Lionel Clingman
*Assistant Examiner*—J. Darland
*Attorney, Agent, or Firm*—Birch, Stewart, Kolasch & Birch

[57] ABSTRACT

A softener composition comprising a quaternary ammonium salt having two hydrocarbon radicals having 12–22 carbon atoms and one unsaturated bond; the stereoisomeric structure of the above salt includes both the cis-isomer and the trans-isomer with the cis-isomer/-trans-isomer ratio being in the range of from 25/75–90/10.

9 Claims, 1 Drawing Sheet

SOFTENER COMPOSITION CONTAINING CIS- AND TRANS- ISOMERS OF ETHYLENICALLY UNSATURATED QUATERNARY AMMONIUM SALTS

BACKGROUND OF THE INVENTION

1. Field of the Invention

The present invention relates to a softener composition which provides excellent water absorbency to treated clothing.

2. Description of the Prior Art

Most of the presently commercially available softener compositions for ordinary household use are compositions comprising; as a main ingredient, Di-(hydrogenated beef tallow alkyl) dimethyl ammonium chloride.

This quaternary ammonium salt exerts good softening and antistatic effects to various fibers, even when used in small amounts.

It is believed that a softener molecule needs to impart a lipophilic property in order to exert excellent softening effects, since the softening effect by the softener is the result of a lowering of the friction coefficient on a fabric surface which is caused by a lubricating effect based upon the lipophilic parts of softener molecule adsorbed on the fabric surface.

However, this lipophilic property is defective in making the treated clothing water-repellant and reduces the water-absorbency of the treated clothing, especially causing a remarkable reduction in water-absorbency when the concentration of the softening agent is high.

From this point of view, many investigations on the softener compound have been conducted in order to improve the water-absorbency.

It is known that dioleyl dimethyl quaternary ammonium salt is a softener compound which exerts excellent water-absorbency (JAOCS, Vol. 60, No. 6, 1166–1169).

However, the softener compound comprising the above compound exerts more water-absorbency than Di-(hydrogenated beef tallow alkyl) dimethyl quaternary ammonium salt, yet it exerts less softening properties than the others.

On the other hand, even though the above compound is used with other softening agents, for example, Di-(hydrogenated beef tallow alkyl) dimethyl quaternary ammonium salt in order to improve the softening property, a reduction in water-absorbency occurs.

Under the situation described above, the present inventors have conducted research and studies eagerly in order to find the quaternary ammonium salt which exerts greater water-absorbency and a greater softening property than the usual dioleyl type quaternary ammonium salt. Consequently, the inventors have found that unsaturated quaternary ammonium salt having specific stereoisomeric structure exerts good softening effects as well as remarkably increased water-absorbency.

SUMMARY OF THE INVENTION

The present invention provides a softener composition comprising at least one quaternary ammonium salt having the following formula (I)–(III):

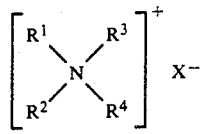

(I)

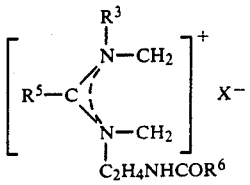

(II)

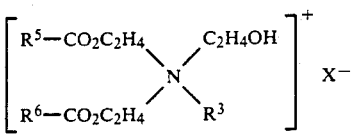

(III)

wherein $R^1$ and $R^2$ each represent a hydrocarbon radical having 12–22 carbon atoms, preferably 16–22 carbon atoms and one unsaturated bond. Moreover, the stereoisomeric structure of the above salts having the formula (I) include both the cis-isomer and the trans-isomer with the cis-isomer/trans-isomer ratio being in the range of from 25/75–90/10; $R^3$ and $R^4$ each represent a methyl, ethyl or

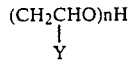

in which n is an integer from 1 to 5, and Y represents H or methyl; $R^5$ and $R^6$ each represent a hydrocarbon radical having 11–21 carbon atoms, preferably 15–21 carbon atoms and one unsaturated bond. Moreover, the stereoisomeric structure of the above salts having the formula (II)–(III) include both the cis-isomer and the trans-isomer with the cis-isomer/trans-isomer ratio being in the range of from 25/75–90/10; and X represents a halogen, $CH_3SO_4$ or $C_2H_5SO_4$.

DETAILED DESCRIPTION OF THE PREFERRED EMBODIMENT

Figure 1:
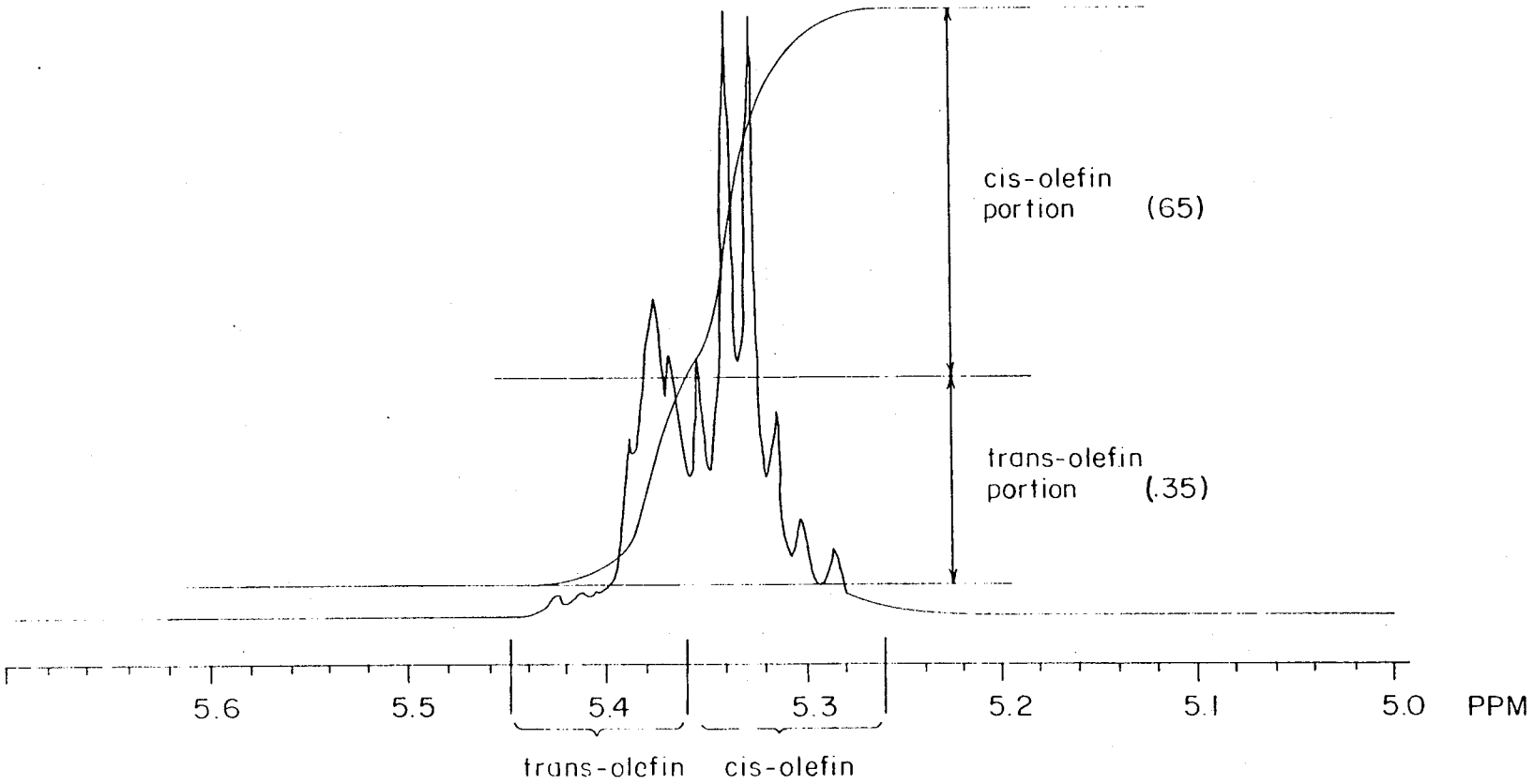
FIG. 1 is a drawing which shows an NMR chart of the quaternary ammonium salt labeled 1–2 of the present invention.

With regard to the properties of the softener composition of the present invention, the stereoisomeric ratio of $R^1$ and $R^2$ in formula (I) and $R^5$ and $R^6$ in formulas (II) and (III) is particularly important in order to satisfy the requirements of both the softening property and water-absorbency.

Namely, it is necessary that the stereoisomeric structure of the quaternary ammonium salt having the formula (I)–(III) includes both the cis-isomer and trans-isomer, and moreover, it is necessary that the cis-isomer/-trans-isomer ratio is in the range of from 25/75–90/10, preferably from 50/50–80/20.

The ratio of the cis-isomer to the trans-isomer in the present invention means, for example, with respect to the compound salt of formula (I), the total ratio of both $R^1$ and $R^2$.

As an example, with respect to the compound salt of formula (I), $R^1$ can be the cis-isomer, and $R^2$ can be the trans-isomer.

The present ratio can also be obtained by mixing a salt wherein both $R^1$ and $R^2$ are the cis-isomer with a salt wherein both $R^1$ and $R^2$ are the trans-isomer, such that the total ratio of the cis-isomer to the trans-isomer is within the required range as described above.

In the same manner, the ratio with regard to $R^5$ and $R^6$ in the compound salt of formulas (II) and (III) can also be obtained.

There are several methods to preferably adjust the ratio of the cis-isomer to the trans-isomer to arrive at the distinctive feature of the present invention.

One method to adjust the cis- and trans-isomer ratio is by mixing the cis-isomeric and the trans-isomeric quaternary ammonium salt after producing them separately.

Another method is to produce the quaternary ammonium salt from a mixture of the cis-isomeric and the trans-isomeric fatty acid or ester thereof after mixing them according to the desired ratio.

Another method is to produce the quaternary ammonium salt from the mixture after adjusting the ratio thereof by isomerizing a portion of the cis-isomeric fatty acid or ester thereof into the trans-isomer in the presence of, e.g., a metallic catalyst, etc.

Still a further method utilized to adjust the ratio is by isomerizing between the cis-isomer and the trans-isomer during the process for producing the quaternary ammonium salt using the fatty acid or ester thereof as a precursor.

Examples of fatty acids used as precursors of the compound salt having the above formula (I)–(III) are cis-6-octadecenoic acid, cis-9-octadecenoic acid (oleic acid), cis- 13-docosenoic acid, trans-6-octadecenoic acid, trans-7-octadecenoic acid, trans-13-docosenoic acid.

In case of manufacturing the softener composition of the present invention, the unsaturated quaternary ammonium salt, having the formula (I)–(III) described above, is commonly used in the range of 3–20% by weight, based on the total weight of the composition.

In order to exert both the softening property and water-absorbency, it is necessary that both the cis-isomer and the trans-isomer exist together and, furthermore, that the ratio is within a certain range as discussed above. While not being bound to any theory on the reason why this is so, the present inventors believe that when the quaternary ammonium salt of the present invention is adsorbed onto clothing, the orientation of the salts are disturbed due to this mixture of the cis-isomer and the trans-isomer, and it is this disturbed orientation which results in a decrease in water-repellency while increasing the water absorbency.

If the ratio of the cis-isomer to the trans-isomer is less than 25/75, water-absorbency decreases remarkably.

If the ratio of the cis-isomer to the trans-isomer is greater than 90/10, both water-absorbency and the softening property decrease.

In practicing the present invention, dimethylpolysiloxane (silicone) or modified silicone can be added to the composition, in the range of from 0.5–10% by weight, based on the weight of compound in formula (I)–(III) in order to enhance the softening property and water-absorbency of the unsaturated quaternary ammonium salt of formula (I)–(III).

Up to now, silicone is known an ingredient which enhances the softening effect and ironing characteristics of a fabric (see Japanese patent laid-open No. 52-53094).

In conjunction with these above characteristics, it is known that silicone itself has water-repellency and adversely affects water-absorbency.

The fact that silicone enhances water-absorbency when it is used in conjunction with the specific unsaturated quaternary ammonium salt of the present invention is surprising since it is contrary to what would be expected to one skilled in the art.

More specifically, dimethylpolysiloxane or a modified silicone, having a viscosity of 20–10000 cps at 25° C. is preferred.

Modified silicones useful in the present invention include, for example, polyoxyethylene modified silicone and amino-modified silicone.

It is preferable that the amount of the modification is less than 10%.

It is preferable that dimethylpolysiloxane or modified silicones are emulsified with a polyoxyethylene-type nonionic surfactant or a monoalkylcationic-type or dialkylcationic-type cationic surfactant prior to their use.

In addition to the quaternary ammonium salts of formula (I)–(III), the following substances may be incorporated in any amount which will not impede the effects of the softener composition of the present invention; other known quaternary ammonium salts; polyoxyethylene alkyl or alkenyl ether, polyoxyethylene alkylphenyl ether, polyoxyethylene oxypropylene polyalkylenepolyamine, nonionic surfactants such as glycerine or pentaerythritol which has been partially esterified with higher fatty acids such as stearic acid or oleic acid, or 2-ethylhexanoic acid; water-soluble salts such as sodium chloride, ammonium chloride and calcium chloride; solvents such as ethyl alcohol, isopropyl alcohol, propylene glycol and ethylene glycol; urea; germicides; antioxidants; pigments, dyes, perfumes, etc.

The present invention will now be further described by reference to the following illustrative Examples. Of course, the present invention is to be in no way construed as being limited by these Examples.

EXAMPLE

The softening effects and water-absorbency of the compositions set forth in Table 2 on various fibers were examined.

As the unsaturated quaternary ammonium salt of the present invention, those having the formula set forth in Table 1 were used.

TABLE 1

| COMPOUND NO. | FORMULA OF QUATERNARY AMMONIUM SALT | | $R^1$, $R^2$ or $R^5$, $R^6$ | | | |
|---|---|---|---|---|---|---|
| | FORMULA | CARBON NO. | CIS-ISOMER/TRANS-ISOMER | $R^3$ | $R^4$ | X |
| 1 - 1* | 1 | 18 | 95/5 | $CH_3$ | $CH_3$ | Cl |
| 1 - 2 | 1 | 18 | 65/35 | " | " | " |
| 1 - 3 | 1 | 18 | 50/50 | " | " | " |

TABLE 1-continued

| COMPOUND NO. | FORMULA | FORMULA OF QUATERNARY AMMONIUM SALT $R^1$, $R^2$ or $R^5$, $R^6$ CARBON NO. | CIS-ISOMER/TRANS-ISOMER | $R^3$ | $R^4$ | X |
|---|---|---|---|---|---|---|
| 1 - 4 | 1 | 22 | 70/30 | " | " | " |
| 1 - 5* | 1 | 18 | 20/80 | " | " | " |
| 2 - 1 | 2 | 17 | 70/30 | " | — | $CH_3SO_4$ |
| 2 - 2 | 2 | 17 | 50/50 | " | — | " |
| 3 - 1 | 3 | 17 | 80/20 | " | — | " |

*Comparative Example.

The ratio of the cis-isomer to the trans-isomer was calculated by comparing the integration of the cis-olefinic proton with the integration of the trans-olefinic proton measured by using 400 $MH_z$ NMR (Nihon Electron Co. Ltd.) for example, as seen in FIG. 1.

(1) Softening Treatment

A commercially available cotton towel and cotton knitwork underwear were washed repeatedly 5 times with a commercially available detergent, Zab (a registered trademark for a product of Kao Corporation), and fiber treating agents were removed from the thus-washed fiber products. Then, the fiber products were treated in a 0.1% aqueous solution of the softener composition (water having a hardness of 3.5° DH being used) at a temperature of 25° C. and a bath ratio of 1/30 for 5 minutes under agitation.

(2) Evaluation

The clothes treated according to the above-mentioned method were air-dried in a room and were allowed to stand still in a thermostat chamber maintained at a temperature of 25° C. and a relative humidity of 65% for 24 hours.

The softness and water-absorbency of each cloth was evaluated in the following manner:

(a) softness

The softness was evaluated according to the paired comparison testing method using, as a control, a cloth treated with a comparative softener composition (which contains 5% of Di-(hydrogenated beef tallow alkyl) dimethyl ammonium chloride).

| | |
|---|---|
| +2 | soft |
| +1 | relatively soft |
| 0 | same as control |
| −1 | relatively hard |
| −2 | hard |

(b) water-absorbency

The cotton towel and the cotton knitwork underwear were cut into 3 cm×20 cm rectangular strips.

One end of the cloth was dipped into water to a depth of 2 cm.

After 15 minutes, the rise in water, on each strip was measured in centimeters.

(3) Results

The results obtained are shown in Table 2. As will be apparent from the results shown in Table 2, in the case of the softener of the present invention, water-absorbency was remarkably enhanced while sufficient softness was retained.

TABLE 2

| COMPOSITION NO. | COMPOSITION OF QUATERNARY AMMONIUM SALT | (WEIGHT %) | SILICON (WEIGHT %) | COTTON TOWEL SOFTNESS | COTTON TOWEL WATER-ABSORPTIVITY | COTTON KNITWORK UNDERWEAR SOFTNESS | COTTON KNITWORK UNDERWEAR WATER-ABSORPTIVITY |
|---|---|---|---|---|---|---|---|
| 1* | Di-(hydrogenated beef tallow alkyl) dimethyl ammonium chloride | (5) | — | Standard | 6.1 | Standard | 4.3 |
| 2* | dioleyl dimethyl ammonium chloride | (5) | — | −1 | 9.0 | −1 | 7.0 |
| 3* | Di-(hydrogenated beef tallow alkyl) dimethyl ammonium chloride | (2.5) | — | −0.5 | 6.5 | −0.5 | 4.5 |
| | Dioleyl dimethyl ammonium chloride | (2.5) | | | | | |
| 4* | 1 - 1 | (5) | 0.4 | 0 | 6.3 | 0 | 5.8 |
| 5 | 1 - 2 | (5) | — | 0 | 10.8 | 0 | 8.2 |
| 6 | 1 - 2 | (5) | 0.4 | 0 | 12.3 | 0 | 9.0 |
| 7 | 1 - 3 | (5) | 0.2 | 0 | 12.0 | 0 | 9.2 |
| 8 | 1 - 4 | (5) | 0.4 | 0 | 11.8 | 0 | 9.2 |
| 9* | 1 - 5 | (5) | — | 0 | 6.2 | −1 | 5.9 |
| 10 | 2 - 1 | (5) | — | 0 | 11.0 | 0 | 8.3 |
| 11 | 2 - 2 | (5) | 0.2 | 0 | 12.0 | 0 | 9.2 |
| 12 | 3 - 1 | (5) | 0.4 | 0 | 12.0 | 0 | 9.4 |

*Comparative Example.

Having thus described the invention, it is to be understood that the above embodiment can be modified or changed without departing from the spirit and scope of the invention, for which applicants request protection, and as set forth in the claims hereinbelow.

What we claim is:

1. A softener composition comprising a fabric softening effective amount of at least one quaternary ammonium salt having one of the following formulae (I)–(III):

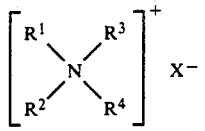

(I)

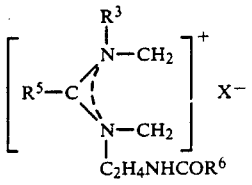

(II)

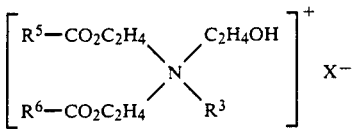

(III)

wherein $R^1$ and $R^2$ each represent a hydrocarbon radical having 12–22 carbon atoms, preferably 16–22 carbon atoms and one unsaturated bond;

$R^3$ and $R^4$ each represent a methyl, ethyl or

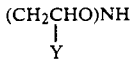

wherein n is an integer from 1 to 5, and Y is H or methyl;

$R^5$ and $R^6$ each represent a hydrocarbon radical having 11–21 carbon atoms and one unsaturated bond;

X represents a halogen, $CH_3SO_4$ or $C_2H_5SO_4$; wherein the stereoisomeric structure of the above said salt having one of the formulae (I)–(III) include both the cis-isomer and the trans-isomer with the cis-isomer and the trans-isomer ratio being in the range of from 25/75 to 90/10.

2. A softener composition as set forth in claim 1 wherein the cis-isomer/trans-isomer ratio is in the range of from 50/50–80/20.

3. A softener composition as set forth in claim 1 further comprising dimethylpolysiloxane or a modified silicone.

4. A softener composition as set forth in claim 3 wherein said dimethylpolysiloxane or said modified silicone has a viscosity of 20–10,000 cps at 25° C.

5. A softener composition as set forth in claim 3 wherein the amount of said dimethylpolysiloxane or said modified silicone is in the range of from 0.5–10% by weight, based on the weight of said quaternary ammonium salt having one of formulae (I)–(III).

6. The softener composition of claim 1, wherein said effective amount of said quaternary ammonium salt having one of the formulae (I)–(III) is from 3–20% by weight based on the total weight of said composition.

7. A method for softening clothes which comprises treating said clothes with the softener composition as set forth in claim 1.

8. A method for softening clothes as set forth in claim 7 further containing dimethylpolysiloxane or modified silicone.

9. The composition according to claim 3 wherein said modified silicone is selected from the group consisting of polyoxyethylene modified silicone and amino modified silicone.

* * * * *